US006250829B1

(12) United States Patent
Brower et al.

(10) Patent No.: US 6,250,829 B1
(45) Date of Patent: Jun. 26, 2001

(54) LOTION APPLICATOR AND ENCLOSURE

(76) Inventors: Maureen Brower, 5273 Tunbridge Wells La. #1, Orlando, FL (US) 32812; Thomas R. Fitzsimons, 541 N. Hartland Ct., Chicago, IL (US) 60622; Steven L. Underwood, 1072 S. Plymouth Ct., Chicago, IL (US) 60605

( * ) Notice: Subject to any disclaimer, the term of this patent is extended or adjusted under 35 U.S.C. 154(b) by 0 days.

(21) Appl. No.: 09/314,532

(22) Filed: May 19, 1999

(51) Int. Cl.[7] ..... A46B 5/04

(52) U.S. Cl. ..... 401/7; 401/132; 604/292; 15/227

(58) Field of Search ..... 401/7, 8, 6, 132, 401/133; 15/104.93, 104.94, 227; 206/213, 210, 278, 292; 383/209; 604/292, 289, 306

(56) References Cited

U.S. PATENT DOCUMENTS

| | | | | |
|---|---|---|---|---|
| 2,621,784 | | 12/1952 | Van Boytham | 401/7 X |
| 2,790,982 | * | 5/1957 | Schneider | 401/7 |
| 3,647,305 | * | 3/1972 | Baker et al. | 401/7 |
| 3,870,150 | * | 3/1975 | Hummel | 15/227 X |
| 4,773,532 | * | 9/1988 | Stephenson | 206/278 |
| 4,804,518 | | 2/1989 | Levine et al. . | |
| 4,902,283 | * | 2/1990 | Rojko et al. | 604/292 X |
| 4,904,524 | | 2/1990 | Yoh . | |
| 5,009,652 | | 4/1991 | Morgan et al. . | |
| 5,039,516 | | 8/1991 | Goodman et al. . | |
| 5,141,803 | | 8/1992 | Pregozen . | |
| 5,487,932 | | 1/1996 | Dunshee . | |
| 5,518,712 | | 5/1996 | Stewart | 424/59 |
| 5,549,924 | | 8/1996 | Shlenker et al. . | |
| 5,679,399 | | 10/1997 | Shlenker et al. . | |

FOREIGN PATENT DOCUMENTS

| | | | | |
|---|---|---|---|---|
| 2453760 | * | 11/1975 | (DE) | 401/7 |
| 2196820 | * | 3/1974 | (FR) | 604/292 |
| 4170925 | | 6/1992 | (JP) . | |

* cited by examiner

*Primary Examiner*—Gregory L. Huson
(74) *Attorney, Agent, or Firm*—Price Heneveld Cooper DeWitt & Litton

(57) ABSTRACT

A storage and applicator article for the convenient and controlled application of lotion to a user's skin has a thin, fabric like cavity applicator that is pre-impregnated with fluid and stored in a fluid impermeable enclosure. Upon opening the enclosure, a user may apply the lotion by inserting their hand in the applicator, which may be configured as a glove or mitten, and spreading the fluid over the skin. The lotion may be a combination sunscreen and insect repellent. A second embodiment of the applicator and storage enclosure of the invention comprises opening on the applicator cooperating with the storage enclosure whereby opening of the enclosure urges the applicator open. Still another embodiment of the applicator of the invention comprises a reusable, reversible applicator cavity that may generally be pulled inside out to expose a fluid impregnated applicator surface.

14 Claims, 4 Drawing Sheets

LOTION APPLICATOR AND ENCLOSURE

FIELD OF THE INVENTION

The present invention relates to applicators useful for applying lotion to the skin. More particularly, the present invention relates to applicators that are impregnated with a lotion and sealed for storage.

BACKGROUND OF THE INVENTION

Lotions such as sunscreen and insect repellent are often called for at the same time. A person hiking in a sunny area, for instance, may apply sunscreen to provide protection from the sun and apply insect repellent for protection from insects. Applying these lotions generally requires a user to place a roughly estimated quantity of lotion on their hand and wipe across an area of the skin to be protected. Such application, when done over large portions of the body, requires the user to repeatedly place lotion on their hand for wiping. This can lead to the hand becoming disadvantageously greasy. Further, as the hand is not absorbent, application with the hand can be un-even or splotchy.

Also, the lotion must be carried in a container. Commercially sold containers for such lotions are typically in the 6 fluid ounce or larger size range. Thus, a person who wishes to carry sunscreen and insect repellent will be generally required to carry two bottles of at least 6 fluid ounce size. Carrying of such bottles is often disadvantageous, particularly in association with recreational activities such as hiking, camping, biking, or water sports.

Further, for insect repellents in particular, aerosol spray cans are typical commercial containers. In addition to being bulky and inconvenient to carry, these can may lead to splotchy and un-even application. Aerosol application problems may be acute when applying to infants, small children, or around the areas of the face. Aerosol application may be further disadvantageous due to the well documented environmental consequences of aerosol Chloro Flouro Carbons ("CFC").

Some developments have been made regarding the problem of portability. In particular, single use pre-moistened applicators contained in a compact, sealed package have been developed. Generally, examples of known commercial embodiments of such products may be referred to as "wet-wipes". A wet wipe as it is generally known comprises a fabric like article impregnated with a fluid, typically a surfactant and/or bactericide, and contained in a sealed package for a single use. When it is to be used, the sealed wet wipe package is torn open, the single use moistened wet-wipe removed, unfolded, and used.

A prior art example of a similar applicator for use with materials including sunscreen or insect repellent is described in U.S. Pat. No. 5,487,932. This reference, however, teaches the use of a single piece sealed element only. That is, the sealed envelope-like package is itself the applicator. Upon opening the envelope, it must be gripped by a small tab and used as an applicator.

An applicator as disclosed in the U.S. Pat. No. 5,487,932 patent, or such as is generally known as wet wipes, would have problems when applying lotions such as sunscreen or insect repellent to the skin. A flat, fabric like swatch that generally comprises a "wet-wipe" type applicator may not be useful with sun screen, which often has a slippery, greasy texture when applied to the skin. A "wet-wipe" swatch would be difficult to hold and maneuver effectively under such circumstances. Further, these difficulties, when using the "wet-wipe", may lead to the user's hand becoming moist with the lotion, making gripping of the applicator even more difficult and also thereby essentially defeating the use of the wipe (i.e. to keep the user's hand free of lotion).

Another example of a prior art applicator is disclosed in U.S. Pat. No. 2,621,784, that generally discloses a one piece applicator that comprises an external pocket for inserting a portion of the hand. When unfolded, one side of the enclosure interior comprises an applicator surface for applying lotion. U.S. Pat. No. 2,621,784, however, also offers drawbacks. In particular, U.S. Pat. No. 2,621,784 teaches an enclosure for receiving the hand is not sealed or closed prior to use. Thus, the pocket may be subject to ripping and tearing during storage and carrying about of the article. In addition, the exposed pocket may likewise be subject to collecting debris during storage and carrying about.

An additional problem with applicators such as U.S. Pat. No. 2,621,784 that may comprise a pocket relates to the insertion of the hand into the pocket. Often this requires gripping the lotion-impregnated surface of the pocket, unfolding it, and holding it while a hand is inserted. This often results in undesirably getting lotion on the hand.

Further, applicators that may comprise a pocket may have problems associated with keeping the enclosure interior free of lotion while in storage. If contained in a sealed package, for instance, lotion may escape from the lotion impregnated surface and flow into the pocket interior. This likewise results in a user disadvantageously getting lotion on the hand.

An additional problem associated with the applicators of the prior art is that they are single use. After use, they must be disposed of In addition to being economically disadvantageous, disposable applicators are environmentally troublesome. Further, should a user desire to make several separate applications during a day, for instance, a number of single use, multiple disposable applicators must be carried.

Heretofore unresolved needs therefor exist for applicators for applying sunscreen and insect repellent in combination.

SUMMARY OF THE INVENTION

The present invention generally comprises a storage and applicator article for the convenient and controlled application of a lotion, preferably a sunscreen or insect repellent and most preferably a combination sunscreen and insect repellent, to the skin of a user. The applicator comprises a flexible thin sheet impregnated with the lotion and formed into a cavity having an inner and outer surface defined by a closed distal end, a pair of closed opposite side edges and an open proximal end into which at least a portion of the user's hand may be inserted for manipulation of the flexible thin sheet. The sheet may then be manipulated to deposit and evenly spread a quantity of the lotion from the article to the skin when the outer surface of the article is placed in contact with the skin. The sheet is contained and stored in a fluid impregnated condition in an openable airtight enclosure until lotion is needed for application.

A first embodiment of the applicator sheet cavity comprises a pouch. Other applicator sheet embodiments include a glove and a mitten. These preferred embodiments allow for more effective lotion application than prior art applicators, and additionally do not present the risk of the lotion contacting the hand skin which is enclosed in the applicator. A mitten offers the advantages of low production cost and a desirable wide application surface across the finger enclosure.

A first embodiment of the airtight enclosure of the storage and applicator article of the invention comprises a tearable wrapper fabricated from a fluid impermeable layer encapsulating a single of the fluid impregnated applicators. With this preferred enclosure, a user conveniently need carry only the wrapper and contained applicator, tear the wrapper open, remove the applicator, and apply the lotion with the applicator when desired. Thus, a user advantageously avoids carrying bulkier and heavier bottles of sunscreen and insect repellent.

A second embodiment of the airtight enclosure comprises a larger enclosure that contains a plurality of the applicators. Such an embodiment is advantageous for applications that may require several applications of lotion, such as would be required by a family of four at the beach for a day, for instance.

Preferably, the applicator sheet comprises a plurality of layers, with an absorbent outermost layer comprising the outside surface of the cavity, and a fluid impervious innermost layer comprising the cavity inside surface. The outermost layer is most preferably an absorbent web. The inner fluid impermeable layer preferably comprises a polymeric-based composition including, but not limited to, polyethylenes, ethylene vinyl acetates, and combinations thereof The inner fluid impermeable layer provides for keeping the user's hand substantially free from contact with lotion, while the outer absorbent layer provides a low cost absorbent layer that retains the lotion well until application is desired. A self opening embodiment of the applicator and enclosure of the invention comprises an applicator as generally described above enclosed in the single applicator tearable wrapper enclosure as generally described above, with the wrapper further having a tearably openable edge. The applicator of this preferred embodiment further comprises an openable proximal end into which the hand may be at least partially inserted. The openable proximal end further has opening means that cooperate with the enclosure tearable openable edge, whereby tearing said edge open exposes the openable end of the applicator in an open condition for insertion of the hand. Thus, a user advantageously is not required to grip, unfold, or otherwise handle the fluid impregnated applicator.

Preferred applicator opening means comprises a bond on the outer surface of the applicator near the applicators openable proximal end. The applicator outer surface has first and second sides, and the storage enclosure has upper and lower flexible sheets. The bonded surface removably attaches the applicator outer surface first and second sides to the enclosure's upper and lower flexible sheets, respectively, near the enclosure's tearably openable edge. Tearing open of the edge and spreading the enclosure upper and lower sheets thereby urges the applicator's openable end open.

In addition to the advantage of allowing a user to easily and conveniently insert a hand into the applicator without having to grip, unfold, or otherwise handle the fluid impregnated applicator, this self-opening embodiment further advantageously tends to urge the applicator openable end closed during storage. This results as the applicator openable end is removably affixed to the storage enclosure top and bottom sheets and the storage enclosure has a generally flat shape. Thus, the applicator openable end is held closed between the enclosure upper and lower sheets, and the cavity is generally kept free of fluid during storage.

Still another embodiment of the invention comprises a reversible applicator. This applicator generally comprises the thin sheet flexible cavity into which the hand may be at least partially extended as described previously. The cavity has an interior, an exterior, and first and second surfaces. The interior is initially defined by the first surface, which is impregnated with the lotion, while the cavity exterior surface is initially defined by the second surface. The cavity is reversible, so that the first surface may be pulled from the interior to define the exterior surface, with the second surface thereby defining the interior. A hand may then be at least partially inserted into the interior for manipulating the applicator to transfer the lotion from the first surface to the skin.

The preferred applicator of this reversible embodiment further comprises a flexible tab attached to the cavity first surface for gripping and pulling to reverse the cavity interior and exterior. The cavity has a closed distal end and an open proximal end, with the preferred flexible tab attached to the first surface proximate the cavity distal end for pulling through the open proximal end to thereby reverse the cavity interior and exterior.

Also, the first surface preferably comprises sealing means for sealing the open proximal end. Preferred sealing means are re-sealable, so that the cavity may be re-used, with lotion applied to the first surface as desired.

Thus, the reversible applicator of the invention provides numerous advantages. As it is self contained, no storage enclosure is required, thereby offering lower manufacturing cost and effort, as well as reduced disposal requirements. The reversible applicator also provides an easy and convenient installation on the hand that advantageously does not require a user to place lotion on the hand. Further, the reversible applicator with its preferred sealing means is re-usable, with resultant cost and environmental advantages.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the several embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation. Where specific dimension and material specifications have been included or omitted from the specification or the claims or both, it is to be understood that the same are not to be incorporated into the appended claims.

Therefore, it is the primary object of the present invention to provide an applicator and enclosure that is readily adapted to function advantageously with a number of different lotions, such as sunscreen and insect repellent.

It is a further object of the present invention to provide a lotion applicator and enclosure that is easily assembled and disassembled.

It is an additional object of the invention to provide a portable, compact lotion applicator cavity and enclosure whereby opening of the storage enclosure urges the applicator cavity open.

It is a still further object of the invention to provide a portable, compact lotion applicator that does not require a storage enclosure.

It is a yet another object of the invention to provide a portable, compact lotion applicator that is re-usable.

These and other objects, along with the various features and structures that characterize the invention, are pointed out with particularity in the claims annexed to and forming a part of this disclosure. For a better understanding of the applicator and enclosure of the present disclosure, its advantages and the specific objects attained by its uses, reference should be had to the accompanying drawings and descriptive matter in which there are illustrated preferred embodiments of the invention.

While embodiments of the applicator and enclosure are herein illustrated and described, it is to be appreciated that various changes, rearrangements and modifications may be made therein, without departing from the scope of the invention as defined by the appended claims. As such, those skilled in the art will appreciate that the conception upon which this disclosure is based may readily be used as a basis for designing other structures, methods, and systems for carrying out the several purposes of the present invention: It is important, therefore, that the claims are regarded as including such equivalent constructions as far as they do not depart from the spirit and scope of the present invention.

Further, the purpose of the Abstract is to enable the U.S. Patent and Trademark office and the public generally, and especially those skilled in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

DETAILED DESCRIPTION

Figure 1:
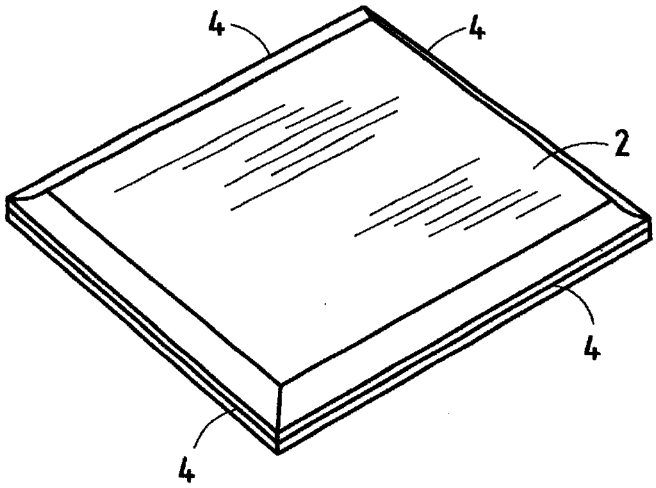
FIG. 1 is a perspective view of a first embodiment of a storage enclosure of the invention with an applicator stored therein.
Figure 2:
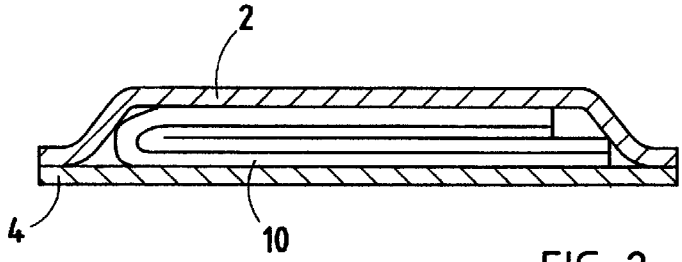
FIG. 2 is a cross sectional view of the first embodiment of the storage enclosure and applicator of the invention.

Turning now to the drawings, FIG. 1 is a perspective view of a first embodiment of the airtight enclosure 2 of the invention, with a single fluid impregnated applicator contained therein (not illustrated). Enclosure 2 is preferably comprised of a fluid impermeable, lightweight material that may readily be torn open. Examples of suitable materials include, but are not limited to, aluminum foils, and polymeric-based compositions including, but not limited to, polyethylenes, ethylene vinyl acetates, polyvinyl resins, cellulose acetates, and combinations thereof Enclosure 2 may be constructed by bonding two layers together about edges 4, with a fluid impregnated applicator held therebetween. FIG. 2 is a cross sectional view of enclosure 2 with folded applicator 10 held therein. Upon tearing open edge 4 of enclosure 2, applicator 10 is released and may be unfolded for ready use.

Figure 3:
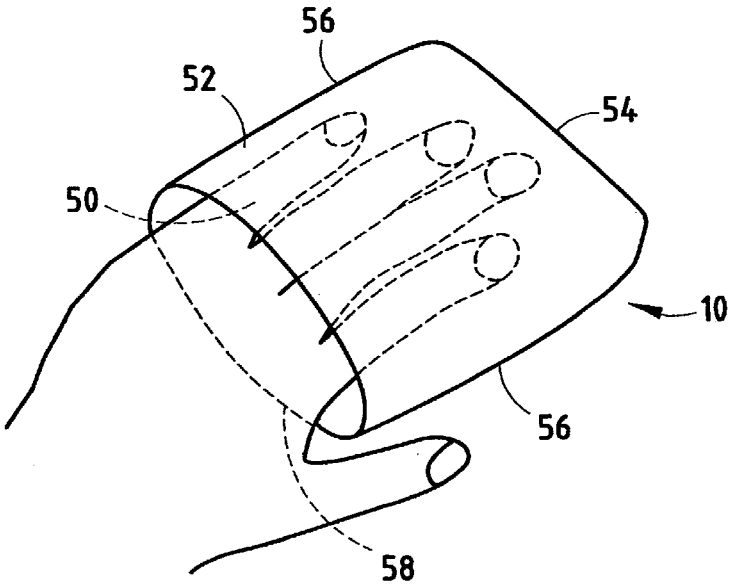
FIG. 3 is a perspective view of the first embodiment of the applicator of the invention.
Figure 8:
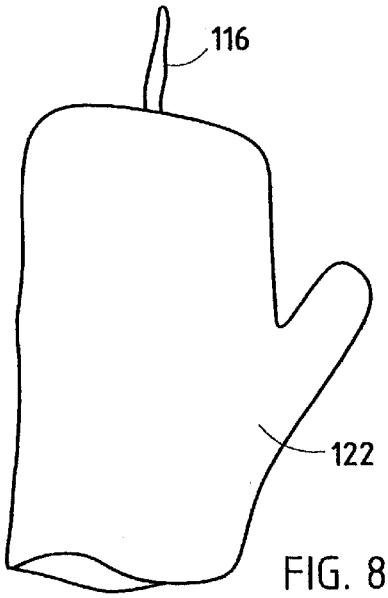
FIG. 8 is a perspective of an additional embodiment of the applicator of the invention.

FIG. 3 is a perspective view of a first embodiment of applicator 10 of the invention. FIG. 3 shows applicator 10 generally comprising a cavity with inner surface 50, outer surface 52, closed distal end 54, a pair of closed side edges 56, and open proximal end 58 into which a hand may be at least partially inserted for manipulating applicator 10. Outer surface 52 is impregnated with lotion for applying to the skin. Applicator 10 may comprise a simple pouch as generally illustrated in FIG. 3, or may preferably comprise a glove or mitten, as shown in FIG. 8 and further discussed below. The applicator 10 may also accommodate different shapes that correspond to the shape of a figure, with the edges of said sheets affixed to one another except for an edge portion comprising a tearably openable edge portion. The figures could be a dinosaur or other animals, toys and popular figures.

Figure 4:
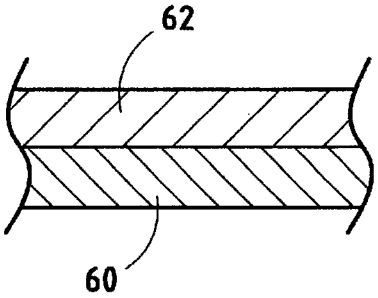
FIG. 4 is a cross section view of a portion of a preferred applicator of the invention.

FIG. 4 is a partial cross section of a preferred multiple layer sheet applicator of the invention, with innermost fluid impermeable layer 60 comprising the sheet inside surface or inner layer and outermost absorbent layer 62 comprising the outer surface of the sheet applicator for storing and dispensing said fluid. Preferred materials for inner layer 60 are polymeric-based compositions including, but not limited to, polyethylenes, ethylene vinyl acetates, and combinations thereof Preferred outermost absorbent layer 62 is an absorbent web composition comprised of materials including, but not limited to, cotton, nylon, polyolefins, polyesters, acetates, and rayons. "Absorbent web" as used herein is intended to include non-woven webs formed by air or hydro entanglement, or adhesive joining of staple fibers or continues filaments, as well as woven webs. Outermost absorbent layer 62 may be treated with surface active agents to enhance wettability, as may be desirable for a given lotion. Preferably, layer 60 is thermally bonded or bonded with adhesive to innermost layer 62. It is noted that although FIG. 4 shows an embodiment having two layers, other embodiments of the applicator may comprise three or more layers. It is further contemplated that single ply construction can also be beneficially applied to the present invention.

The lotion to be dispensed by the various applicators of the invention may comprise any lotion as may be desired, including, but not limited to, moisturizer, petroleum based gels, medicaments, sun screen, and insect repellent. Preferably, the lotion dispensed by the applicator of the invention comprises a combination insect repellent and sunscreen. One example of the preferred lotion is described in U.S. Pat. No. 5,518,712 to Stewart, et al., herein incorporated by reference in its entirety.

Figure 5:
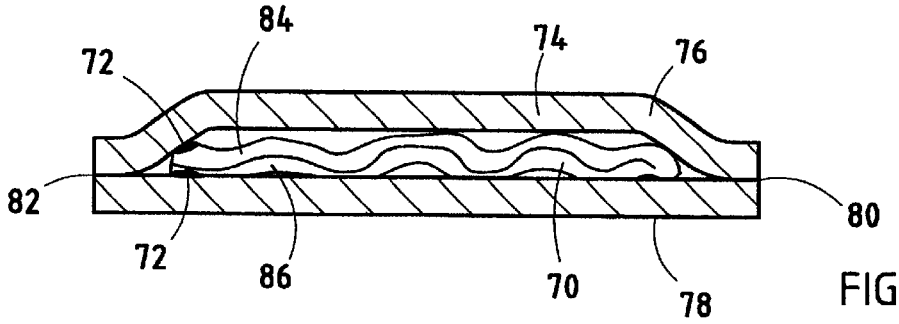
FIG. 5 is a cross section of a second embodiment of the enclosure and applicator of the invention.

FIG. 5 is a cross section of the self opening embodiment of the storage enclosure and applicator of the invention. Applicator 70 is a flexible, thin sheet cavity applicator as generally described above, with all of the elements as illustrated in FIG. 3, except that applicator 70 further comprises an opening means 72, preferably a bond surface, for urging its proximal open end open, as will be described herein. Storage enclosure 74 is also as generally described above, comprising upper flexible thin sheet 76 and lower flexible thin sheet 78 that are joined together about their edges 80, with one of the edges comprising a tearably openable edge 82. Tearably openable edge 82, upper sheet 76, and lower sheet 78 cooperate with applicator bond surface 72 to urge applicator openable proximal end open when tearable edge 82 is torn open and sheets 76 and 78 are separated.

Preferred applicator opening means further comprises the bond surface 72 shown in FIG. 5 removably attaching a first side 84 of applicator 70 outer surface to enclosure upper flexible sheet 76, and likewise removably attaching a second side 86 of applicator 70 outer surface to enclosure lower flexible sheet 78.

Figure 6A:
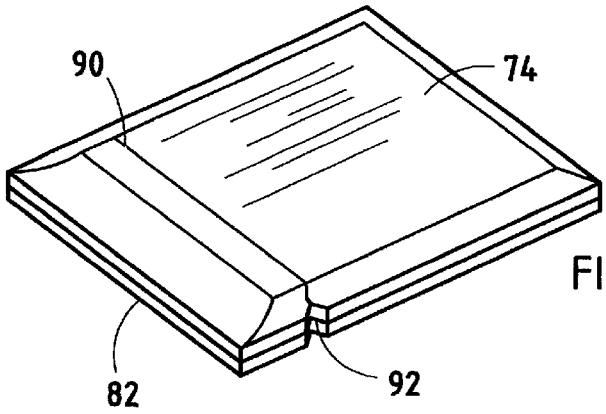
FIGS. 6A, 6B, 6C, 6D, and 6E are perspective views of the process of opening the second embodiment of the enclosure and applicator of the invention.
Figure 6B:
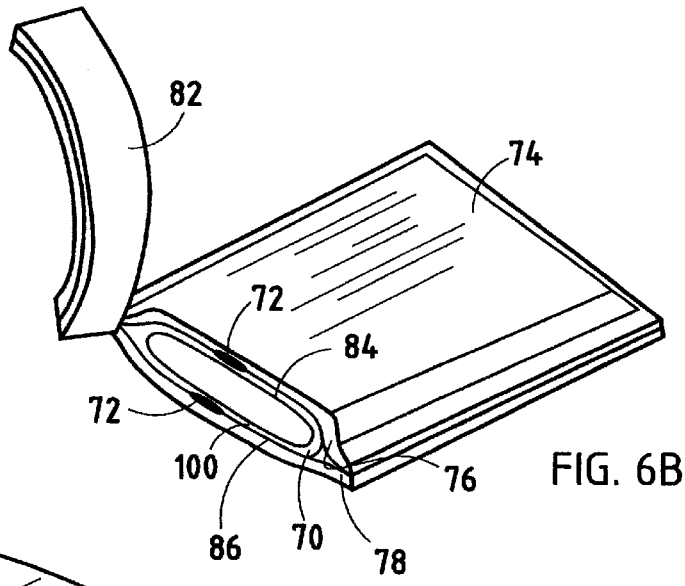
Figure 6C:
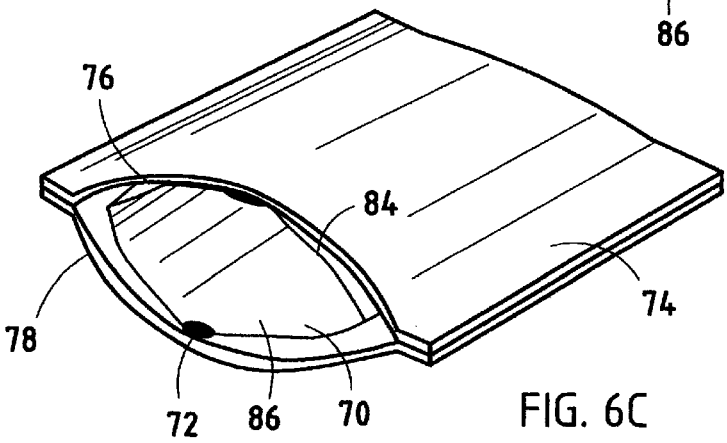
Figure 6D:
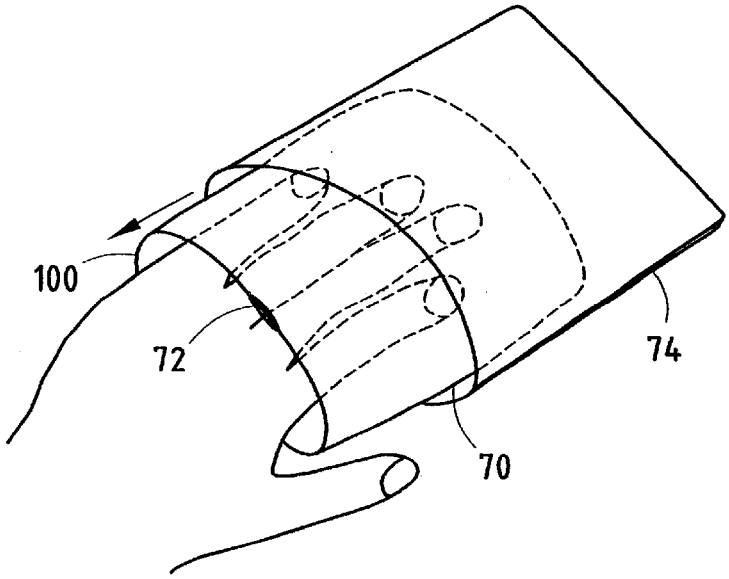
Figure 6E:
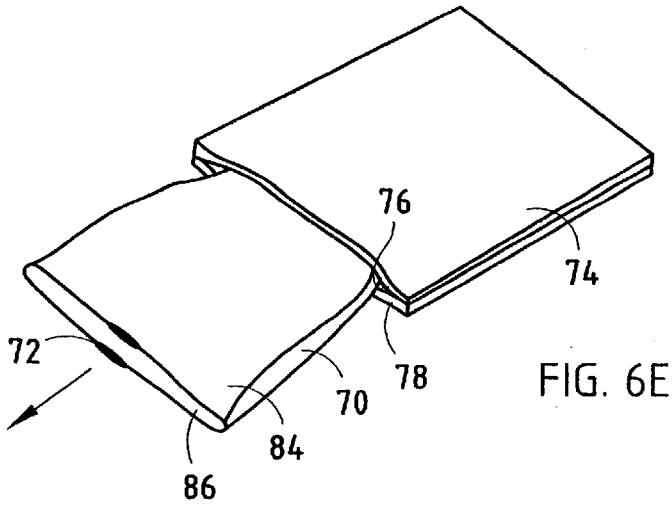

FIGS. 6A, 6B, 6C, 6D, and 6E show perspective views of the process of opening enclosure 74 and applicator 70. In FIG. 6A, tearable openable edge 82 can be seen in greater detail. Edge 82 may comprise perforations or etching 90 as illustrated to ease tearing. Further, ends of etching 90 may comprise notches 92 for further ease in tearing. In FIG. 6B, edge 82 has been torn open, exposing applicator proximal openable end 100 and bond surface 72. FIG. 6C shows that as enclosure upper sheet 76 and lower sheet 78 are urged apart, opening means bond surface 72 likewise urges applicator proximal end 100 open. FIG. 6D shows a hand being partially inserted into opened proximal end 100, and applicator 70 being removed from enclosure 74. Opening means bond surface 72 is preferably pressure sensitive, and is of sufficient binding strength to removably attach applicator first and second sides to the enclosure, but not of excessive binding strength to prevent easy removal of applicator 70 from the enclosure 74. FIG. 6E shows the applicator 70 mostly removed from the enclosure 74.

The self-opening applicator 70 of the invention may comprise the general shapes as described herein in reference to other applicators of the invention. Further, applicator 70 may comprise a plurality of layers, as is described herein in reference to other applicator embodiments, and is shown generally in FIG. 4.

Figure 7A:
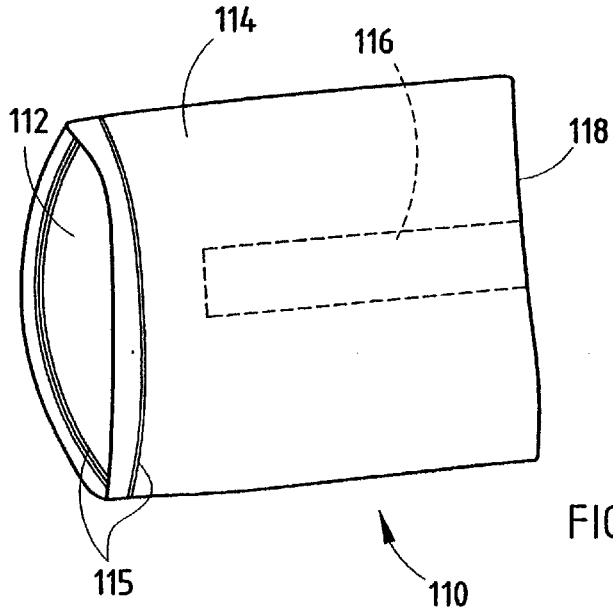
FIGS. 7A, 7B, and 7C are perspective views of a third embodiment of the applicator of the invention, generally comprising a reversible applicator.
Figure 7B:
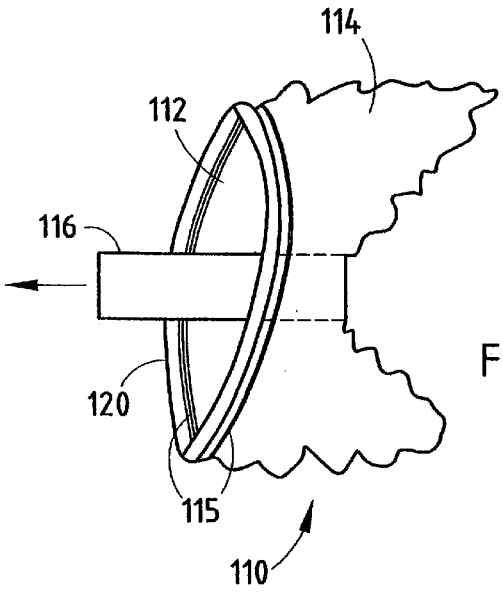
Figure 7C:
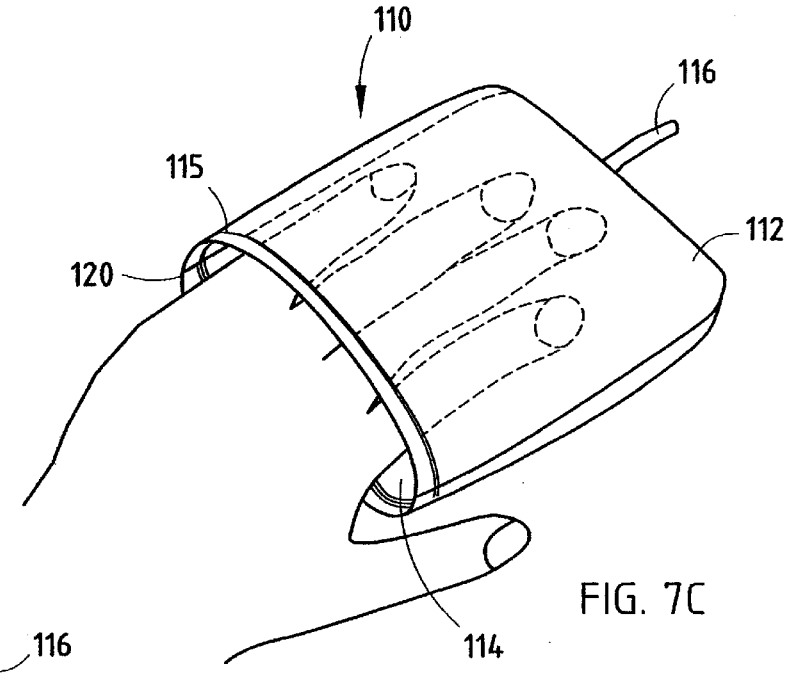

FIGS. 7A, 7B, and 7C show a perspective of a third embodiment of the applicator of the invention, generally comprising a reversible applicator. This reversible applicator, as generally described below, may be incorporated into the embodiment described above and illustrated in FIGS. 6A–6E, or may embody a self-contained re-useable applicator as illustrated in FIGS. 7A–7E.

FIG. 7A shows a perspective view of a preferred reversible applicator 110. Applicator 110 comprises an interior and an exterior, with a first surface 112 initially defining the interior and a second surface 114 initially defining the exterior. First surface 112 is impregnated with lotion. To apply the lotion to the skin, first surface 112 and second surface 114 are reversed, so that first surface 112 defines the cavity exterior, and second surface 114 defines the cavity interior. A hand may then be at least partially inserted into the cavity interior to manipulate the applicator to transfer lotion from the first surface 112 to the skin. As the reversible applicator 110 of the invention may be stored with dry second surface 114 defining the cavity exterior, no storage enclosure is required. This offers savings in manufacture cost, and eliminates disposal needs.

Preferred applicator 110 further comprises re-sealing means 115 for sealing the cavity interior and to thereby store the lotion. Preferred re-sealing means may comprise cooperating interengaging elongated ridges as are generally known in the art. Other sealing means as are known may likewise be comprised. With such re-sealable sealing means, applicator 110 is reusable, with additional lotion applied to first surface 112 when needed.

Preferably, applicator 110 further comprises flexible tab 116 attached to cavity closed distal end 118. As illustrated in FIG. 7B, tab 116 may be pulled through applicator open proximal end 120 to reverse surfaces 112 and 1 14. FIG. 7C shows applicator 110 with surfaces reversed, with fluid impregnated first surface 112 now defining the cavity exterior, and second surface 114 defining the cavity interior. A hand may then be at least partially inserted into open proximal end 120 for manipulating applicator 110, in the preferred mode of not exposing the hand to significant amounts of lotion.

Although FIGS. 7A–7C illustrate cavity 110 as generally comprising a pouch, other applicator embodiments include, but are not limited to, a glove or a mitten 122, as illustrated in FIG. 8. Further, applicator 110 may comprise a plurality of layers, as is described herein in reference to other applicator embodiments, and is shown generally in FIG. 4.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A storage and applicator article for application of lotion comprising:

a) a flexible thin sheet applicator having an outer surface impregnated with the lotion, said applicator formed into a cavity having an outer surface, said cavity defined by a closed distal end and closed side edges and an openable proximal end into which at least a portion of the hand of the user may be inserted for manipulation of said applicator flexible thin sheet such that a quantity of the lotion is transferred from the article to the skin of the user when said outer surface of the article is placed in contact with the skin of the user, said applicator cavity outer surface having first and second sides, said openable proximal end forming a tearable openable edge;

b) applicator opening means for opening said cavity proximal end, said applicator opening means comprises a bond surface removably attaching said openable proximal end outer surface first side to said storage enclosure upper flexible thin sheet proximate said tearable openable edge, said bond surface attaching said openable proximal end second side to said storage enclosure lower flexible thin sheet proximate said tearable openable edge, said applicator openable proximal end thereby urged open when said storage enclosure tearable openable edge is torn open and said upper and lower enclosure sheets are separated; and c) an openable airtight storage enclosure within which said applicator is removably stored until lotion is needed for application, said airtight enclosure defined by upper and lower flexible thin sheets connected to one another about their edges, a portion of said edges being openable and said storage enclosure cooperating with said applicator opening means whereby opening said storage enclosure urges said applicator proximal end open.

2. A storage and applicator article as in claim 1, wherein said storage enclosure upper and lower sheets have a substantially square shape, with three edges of said sheets affixed to one another, the fourth edge comprising said tearable openable edge.

3. A storage and applicator article as in claim 1, wherein said storage enclosure upper and lower sheets have a geometric shape corresponding to the shape of a figure, with the edges of said sheets affixed to one another except for an edge portion comprising said tearable openable edge.

4. A storage and applicator article as in claim 1, wherein the lotion comprises a combination of sunscreen and insect repellent.

5. A storage and applicator article as in claim 1, wherein said applicator comprises a mitten.

6. A storage and applicator article as in claim 1, wherein said applicator comprises a glove.

7. A storage and applicator article as in claim 1, wherein said outer surface impregnated with said lotion defines a first side and said cavity further comprises an opposite second side, wherein said second side of said cavity is initially exterior said cavity and said first side is initially interior said cavity, such that said cavity is reversible whereby said first side is exterior said cavity and said second side is interior said cavity, with said second side thereby defining said cavity interior into which a hand may be at least partially inserted for manipulation of said applicator.

8. A storage and applicator article as in claim 7, further comprising a flexible tab attached to said lotion impregnated first side whereby gripping and pulling upon said tab urges the reversal of said first and second sides.

9. A storage and applicator article for application of lotion comprising:

a) a flexible thin sheet applicator impregnated with the lotion, said applicator formed into a cavity having an outer surface, said outer surface having first and second sides; said cavity defined by a closed distal end, a pair of closed opposite side edges and an openable proximal end into which at least a portion of the hand of the user may be inserted for manipulation of the flexible thin sheet such that a quantity of the lotion is transferred from the article to the skin of the user when the outer surface of the article is placed in contact with the skin of the user;

b) an openable airtight storage enclosure within which said applicator is removably stored until lotion is needed for application, said airtight enclosure defined by substantially square upper and lower flexible thin sheets connected to one another about their four edges, one of said four edges being tearable openable; and c) a bond surface on said outer surface first side and on said outer surface second side proximate said openable proximal end, said bond surface removably attaching said applicator outer surface first side to said enclosure upper thin sheet proximate said tearably openable edge, said bond surface removably attaching said applicator outer surface second side to said enclosure lower flexible thin sheet proximate said tearable openable edge, whereby said applicator openable proximal end is opened when said tearable openable edge is torn open and said enclosure upper and lower sheets are urged apart.

10. An applicator for applying lotion to skin comprising a flexible sealed thin sheet cavity into which a hand may be at least partially extended, said cavity having an interior and exterior and having first and second surfaces, said cavity interior initially defined by said first surface, said first surface being impregnated with the lotion, whereby said cavity is reversible such that said lotion impregnated first surface may be urged to define said cavity exterior, with said second surface thereby defining said cavity interior into which a hand may be at least partially inserted for manipulating said applicator to transfer lotion from said first surface to the skin, wherein said flexible thin sheet applicator cavity has a distal end, two opposing side edges, and a proximal openable end into which said hand may be at least partially inserted, and said applicator further comprising resealable sealing means proximate said applicator openable end, said resealable sealing means comprising interengaging elongated ridges on said first surface proximate said proximal openable end.

11. An applicator for applying lotion comprising a combination of at least sunscreen and insect repellent to skin, comprising a sealed flexible thin sheet cavity, said cavity having an interior and exterior initially defined by first and second surfaces, respectively, a distal end, opposing side edges, and a proximal openable end into which a hand may be at least partially inserted for manipulating said applicator, said cavity interior initially defined by said first surface, said first surface being impregnated with the lotion;

a) a flexible tab attached to said first surface proximate said distal end, whereby pulling said tab through said openable proximal end urges said first surface to said cavity exterior such that said lotion impregnated first surface thereby defines said cavity exterior, and said second surface thereby defines said cavity interior into which a hand may be at least partially inserted for manipulating the applicator to transfer lotion from said first surface to the skin; and b) resealable sealing means on said first surface proximate said applicator openable proximal end.

12. An applicator as in claim 11, wherein said applicator comprises a glove.

13. An applicator as in claim 11 wherein said applicator comprises a mitten.

14. An applicator for applying a lotion, comprising a sealed flexible thin sheet cavity, said cavity having an interior and exterior initially defined by first and second surfaces, respectively, a distal end, opposing side edges, and a proximal openable end into which a hand may be at least partially inserted for manipulating said applicator, said cavity interior initially defined by said first surface, said first surface being impregnated with the lotion;

a) a flexible tab attached to said first surface proximate said distal end, whereby pulling said tab through said openable proximal end urges said first surface to said cavity exterior such that said lotion impregnated first surface thereby defines said cavity exterior, and said second surface thereby defines said cavity interior into which a hand may be at least partially inserted for manipulating the applicator to transfer said lotion from said first surface to the skin; and b) resealable sealing means on said first surface proximate said applicator openable proximal end.

* * * * *

UNITED STATES PATENT AND TRADEMARK OFFICE

CERTIFICATE OF CORRECTION

PATENT NO. : 6,250,829 B1
DATED : June 26, 2001
INVENTOR(S) : Maureen Brower, Thomas R. Fitzsimons and Steven L. Underwood It is certified that error appears in the above-identified patent and that said Letters Patent is hereby corrected as shown below:

Column 2,
Line 33, "of" should be -- of. --;

Column 3,
Line 25, "thereof" should be -- thereof. --;

Column 6,
Line 33, "thereof" should be -- thereof. --;

Column 8,
Line 4, "1 14" should be -- 114 --.

Signed and Sealed this

Twenty-third Day of April, 2002

*Attest:*

*Attesting Officer*

JAMES E. ROGAN
*Director of the United States Patent and Trademark Office*